US010530095B2

(12) United States Patent
Hiscoke et al.

(10) Patent No.: US 10,530,095 B2
(45) Date of Patent: Jan. 7, 2020

(54) RE-WIREABLE ELECTRICAL CONNECTOR

(71) Applicant: SCOLMORE (INTERNATIONAL) LIMITED, Staffordshire (GB)

(72) Inventors: Daniel Hiscoke, Staffordshire (GB); Liam McWilliams, Staffordshire (GB)

(73) Assignee: SCOLMORE (INTERNATIONAL) LIMITED, Staffordshire (GB)

( * ) Notice: Subject to any disclaimer, the term of this patent is extended or adjusted under 35 U.S.C. 154(b) by 0 days.

(21) Appl. No.: 15/567,992

(22) PCT Filed: Apr. 20, 2016

(86) PCT No.: PCT/GB2016/000086
§ 371 (c)(1),
(2) Date: Oct. 20, 2017

(87) PCT Pub. No.: WO2016/170298
PCT Pub. Date: Oct. 27, 2016

(65) Prior Publication Data

US 2018/0138636 A1 May 17, 2018

(30) Foreign Application Priority Data

Apr. 20, 2015 (GB) ..... 1506683.0

(51) Int. Cl.
*H01R 13/633* (2006.01)
*H01R 13/512* (2006.01)
(Continued)

(52) U.S. Cl.
CPC ..... *H01R 13/6335* (2013.01); *H01R 13/512* (2013.01); *H01R 13/639* (2013.01); *H01R 24/22* (2013.01); *H01R 2103/00* (2013.01)

(58) Field of Classification Search
CPC .. H01R 13/639; H01R 13/652; H01R 13/748; H01R 13/20; H01R 13/512;
(Continued)

(56) References Cited

U.S. PATENT DOCUMENTS 4,072,382 A * 2/1978 Reschke ..... H01R 13/4534 439/143
5,791,931 A * 8/1998 Burkhart, Sr. ..... H01R 13/20 439/304
(Continued)

FOREIGN PATENT DOCUMENTS

BE 1 003 915 A6 7/1992
DE 10 2013 010285 A1 12/2013
(Continued)

OTHER PUBLICATIONS

International Search Report, dated Jul. 14, 2016, from corresponding PCT/GB2016/000086 application.
(Continued)

*Primary Examiner* — James Harvey
*Assistant Examiner* — Matthew T Dzierzynski
(74) *Attorney, Agent, or Firm* — Young & Thompson

(57) ABSTRACT

A re-wireable electrical connector including a housing top 13 and a housing base 14 securable together to house a primary chassis member 25, wherein the primary chassis member is removable from the housing top and housing base and includes at least one terminal 22 to which a cable conductor may be secure, the terminal being configured to be an electrically conductive contact with a terminal socket 21 into which the pin of a complimentary conductor may be inserted.

15 Claims, 8 Drawing Sheets

(51) Int. Cl.
*H01R 13/639* (2006.01)
*H01R 24/22* (2011.01)
*H01R 103/00* (2006.01)

(58) Field of Classification Search
CPC ..... H01R 13/6395; H01R 13/635; H01R 13/447; H01R 13/4534; H01R 13/6335; H01R 13/6397; H01R 13/187; H01R 13/44; H01R 13/453
USPC ..... 439/346, 263, 270, 106, 143, 153, 304, 439/345, 700
See application file for complete search history.

(56) References Cited

U.S. PATENT DOCUMENTS

| | | | | |
|---|---|---|---|---|
| 6,193,539 | B1 * | 2/2001 | Chang | H01R 13/6278 439/346 |
| 7,083,458 | B1 * | 8/2006 | Chang | H01R 13/6392 439/263 |
| 7,163,424 | B2 * | 1/2007 | Dancel | G01R 1/06788 439/731 |
| 7,232,349 | B1 * | 6/2007 | Chen | H01R 13/6392 439/810 |
| 7,452,230 | B1 * | 11/2008 | Miller | H01R 13/6392 439/270 |
| 7,484,986 | B1 * | 2/2009 | Wu | H01R 13/6275 439/346 |
| 8,439,697 | B2 * | 5/2013 | Vass | H01R 13/6395 439/270 |
| 8,802,979 | B2 * | 8/2014 | Ziobro | H01R 4/22 174/53 |
| 9,484,669 | B2 * | 11/2016 | Hiscoke | H01R 13/6275 |
| 9,496,648 | B1 * | 11/2016 | Jian | H01R 13/639 |
| 9,634,429 | B2 * | 4/2017 | Chen | H01R 13/6272 |
| 9,847,612 | B2 * | 12/2017 | Okamoto | H01R 24/40 |
| 2004/0267109 | A1 | 12/2004 | Dancel et al. | |
| 2005/0101169 | A1 * | 5/2005 | Ratcliffe | H01R 13/639 439/106 |
| 2011/0079414 | A1 | 4/2011 | Ziobro | |
| 2016/0099529 | A1 | 4/2016 | Okamoto et al. | |

FOREIGN PATENT DOCUMENTS

| | | | | |
|---|---|---|---|---|
| GB | 1 208 834 | A | 10/1970 | |
| GB | 2 383 202 | A | 6/2003 | |
| WO | WO-2013171440 | A1 * | 11/2013 | H01R 13/6275 |
| WO | 2015/005436 | A1 | 1/2015 | |

OTHER PUBLICATIONS

GB Search Report, dated Sep. 5, 2016, from corresponding GB1606796.9 application.

* cited by examiner

RE-WIREABLE ELECTRICAL CONNECTOR

BACKGROUND OF THE INVENTION

Field of the Invention

This invention relates to a re-wireable electrical connector and in particular, though not exclusively, to a connector of the IEC type (known also as a "kettle plug") and in the form of a socket for receiving a plurality of pins.

Description of the Related Art

Re-wireable electrical connectors commonly comprise a main body in the form of a plug or socket which supports an elongate tubular cable guide of a material which is relatively flexible in comparison with that of the main body.

The main body typically comprises two sections which can be separated for access to terminals to which cable conductors are secured. Accordingly when wiring the connector there are three components which subsequently need to be assembled correctly, namely the two sections of the main body and the tubular cable guide. The two sections of the main body typically co-operate in the assembled condition to define an annular groove for location of an outwardly extending rib provided at the end of the flexible cable guide. Thus in the assembled condition the cable guide is held captive relative to the main body.

To wire or re-wire the connector the two parts of the main body are separated, a cable is fed through the tubular sleeve, the or each conductor within the cable is secured to a respective terminal of the main body, and the main body sections are then secured together in a manner in which the guide is held captive relative to the main body.

Although the known connectors perform satisfactorily, they are not wholly convenient for re-wiring, especially if being re-wired by competent but relatively inexperienced persons.

A further feature of many known connectors is that they are of undue length. That is particularly the case for some types of connector that incorporate a locking mechanism. These require space for provision of a locking mechanism that is provided to enable the connector to be separated from the pins of a complementary, mating connector. The provision of a more compact and lockable type of connector would be advantageous, especially for a connector to be used employed in a situation in which space is limited or space reduction is important.

BRIEF SUMMARY OF THE INVENTION

The present invention seeks to provide an improved re-wireable type of electrical connector.

In accordance with the present invention a re-wireable electrical connector comprises a housing top and a housing base securable together to house a primary chassis member, wherein said primary chassis member is removable from the housing top and housing base and comprises at least one terminal to which a cable conductor may be secured, said terminal being configured to be in electrically conductive contact with a terminal socket into which the pin of a complementary conductor may be inserted.

The primary chassis member may be held securely in position in the assembled connector by interengaging with a formation such as a recess or rib which is part of the housing base or top and or it may be held securely by means of screws such as screws or other means provided for securing together the housing top and base.

Thus the invention provides a connector having a chassis section which supports one or more terminals and which serves at least in part as a cable support, with that chassis section being held in position in a sandwich type arrangement between a housing top and a housing base.

A connector in accordance with the present invention may incorporate a safety lock feature such as that described in the specification of our UK patent GB 2383202. In particular it may comprise a safety lock mechanism which comprises release means operable by a handle formation which is slidably supported relative to the main body of the connector. An example of a handle formation of that type is described in the specification of our co-pending UK patent application GB 1208834.0 in the name of Scolmore International Limited.

The handle formation may be an integral part of or secured to a secondary chassis that is slidable relative to the housing top and base.

The secondary chassis may comprise a control arm which is integral with or secured to the handle and which is configured to effect release of the locking mechanism, for example to tilt a locking blade to a release position, when slid in a direction away from the terminal socket.

The primary chassis preferably is arranged, in the assembled condition of the connector, to lie disposed between the secondary chassis, in particular the control arm thereof, and the cable whereby the cable is not subject to sliding movement of the secondary chassis relative to the housing.

In the assembled connector the handle and control arm preferably are supported by being sandwiched between confronting surfaces of the housing top and housing base.

The housing top and housing base may define a recess in which part of the handle formation resides.

As considered in a plane perpendicular to the length of the connector the handle formation may have a cross-sectional shape no larger than that of the assembled housing top and housing base.

BRIEF DESCRIPTION OF THE DRAWINGS

Embodiments of the present invention will now be described, by way of example, with reference to the accompanying diagrammatic drawings in which:—

DETAILED DESCRIPTION OF THE PREFERRED EMBODIMENTS

A lockable connector 10 in the form of a socket of the IEC type (known commonly as a "kettle plug") and of elongate shape comprises a main body 11 to which is slidably attached a handle 12 operable to release a locking mechanism and facilitate removal of the connector from an interconnected complimentary component such as the pin assembly of a kettle or other electrical appliance.

Figure 1:
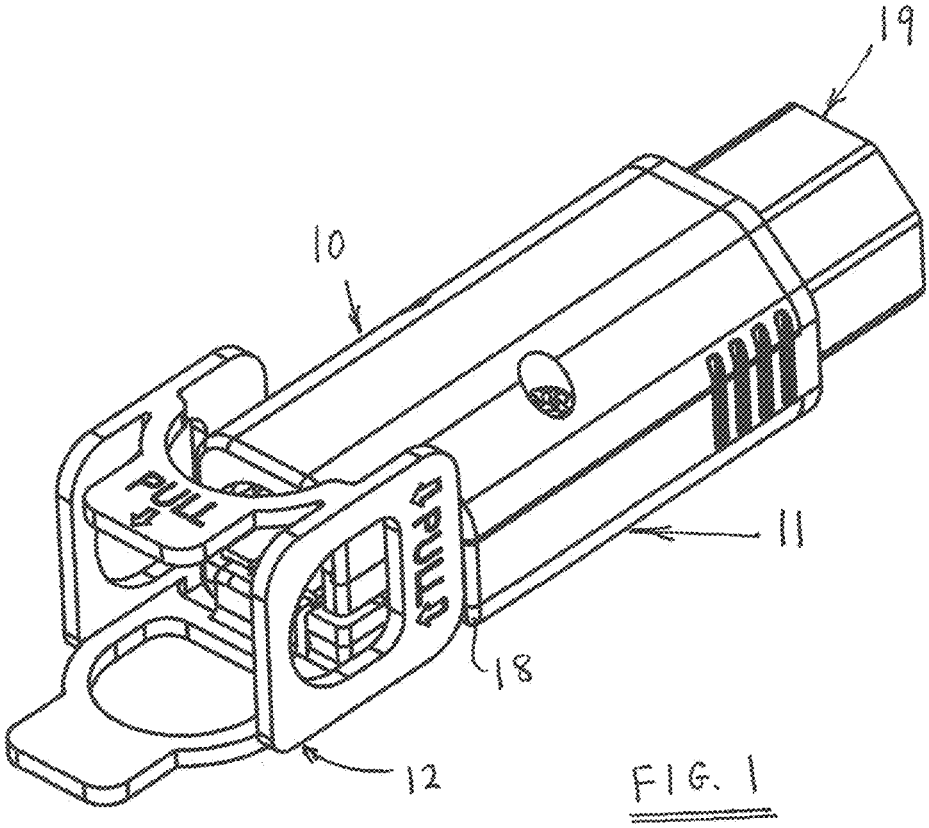
FIG. 1 shows a perspective view of a connector in accordance with a first embodiment of the present invention.
Figure 2:
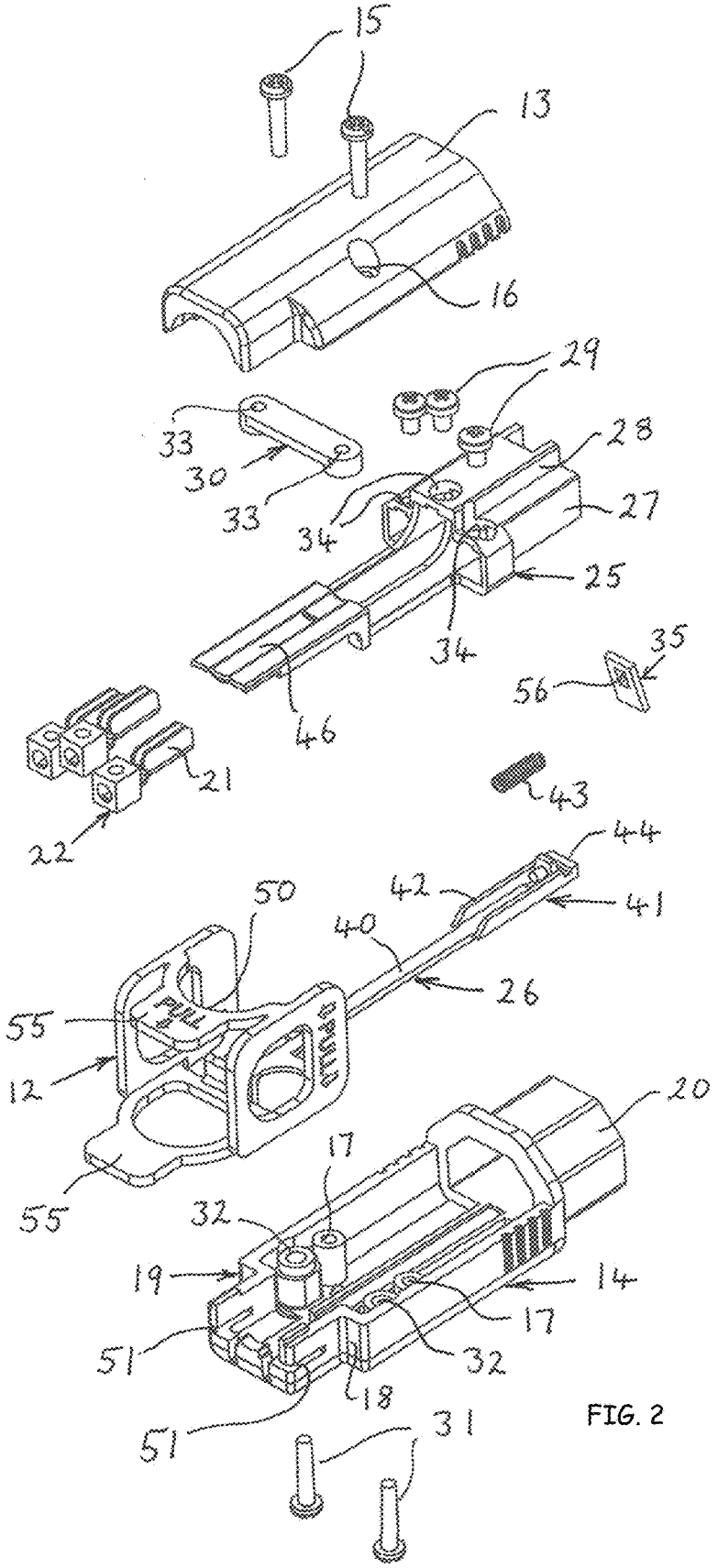
FIG. 2 is an exploded perspective view of the connector of FIG. 1.

In the exploded perspective view of FIG. 2 the main body 11 is shown as comprising a housing top 13 and a housing base 14 securable together by a pair of screws 15 that extend through apertures 16 in the housing top to engage with screw threaded holes 17 in the housing base.

The handle 12 in the assembled connector is located to reside in part in a recess region 18 at one end region 19 of the housing base. The other end region of the housing base defines a tubular formation 20 in which the ends 21 of electrical terminals 22 are located.

In the assembled connector the housing top and base have sandwiched therebetween two chassis components, a main, primary chassis 25 which is secured in position within the connector and a secondary chassis 26 which is slidable within the connector.

The main chassis 25 has an end region 27 which defines a tubular surround 28 for location of three terminals 22. The surround 28 has three apertures 34 each for a retention screw 29 that engages with a respective terminal to hold the terminal in position relative to the chassis and to secure the end of a conductor (not shown) within the terminal.

A cable (not shown) comprising three conductors for connection to the three terminals 22 is held in position by means of a conventional grip bar 30. The grip bar 30 may be drawn downwards against the cable to hold it against the chassis 25 by means of a pair of screws 31 that extend through apertures 32 in the housing base to engage with screw treaded apertures 33 in the bar 30.

The surround 28 of the main chassis 25 acts in part to support a locking blade 35 and spring 36 of a locking mechanism of the type described and explained in more detail in our aforementioned GB 2383202. The blade 35 is positioned to be aligned with a central of the three terminal ends 21, which typically is designated as an earth terminal and of a larger size than the other two terminal ends.

The secondary chassis 26 comprises the handle 12 and a connecting bar 40 that extends to a locking mechanism control region 41. The control region 41 comprises a pair of shoulders 42 that provide sideways support for a compression spring 43 that, in the assembled connector, extends between the blade 35 and an abutment surface (not shown) within the end region 27 of the main chassis. The control region 41 has an end abutment 44 which bears against an end of the blade 35, the blade end thereby being sandwiched between the spring 43 and said abutment 44.

From the foregoing it will be apparent that the secondary chassis 26 lies positioned between the main chassis 25 and the housing base 14. In consequence a cable secured to and supported on the upper surface 46 of the main chassis is not exposed to and is thereby protected from sliding movement of the secondary chassis 26 whenever the handle is operated to move the locking mechanism.

Sliding movement of the secondary chassis is effected by pulling of the handle 12 which then acts against the force of the spring 43 to move the locking plate from a tilted, locking orientation towards an upright position for facilitating release of a pin that has been help captive in the plate. Subsequent pulling of the handle enables the connector to be separated from the pin(s) of a complimentary component. Movement of the handle is guided by a pair of ribs 50 that extend inwardly, towards one another and slide within respective grooves of a pair of groove 51 at the recess region 18 of the housing base.

The construction of the connector and manner in which it may be employed for connection to the end of a cable or for re-wiring will be further apparent from FIGS. 3 to 8.

Figure 3:
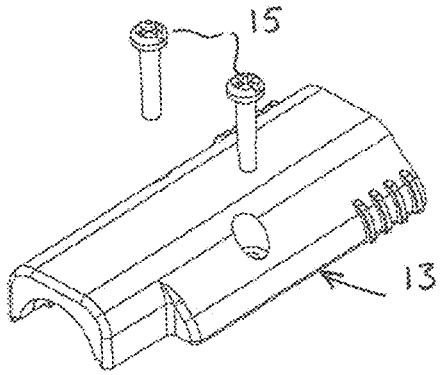
FIGS. 3 to 8 are exploded perspective views showing successive stages in the disassembling of the connector of FIG. 1.

FIG. 3 shows removal of the screws 15 to allow removal of the housing top 13.

Figure 4:
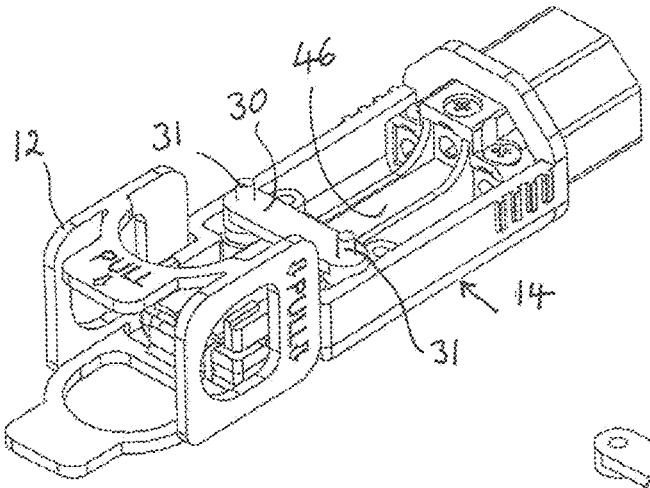
Figure 4:
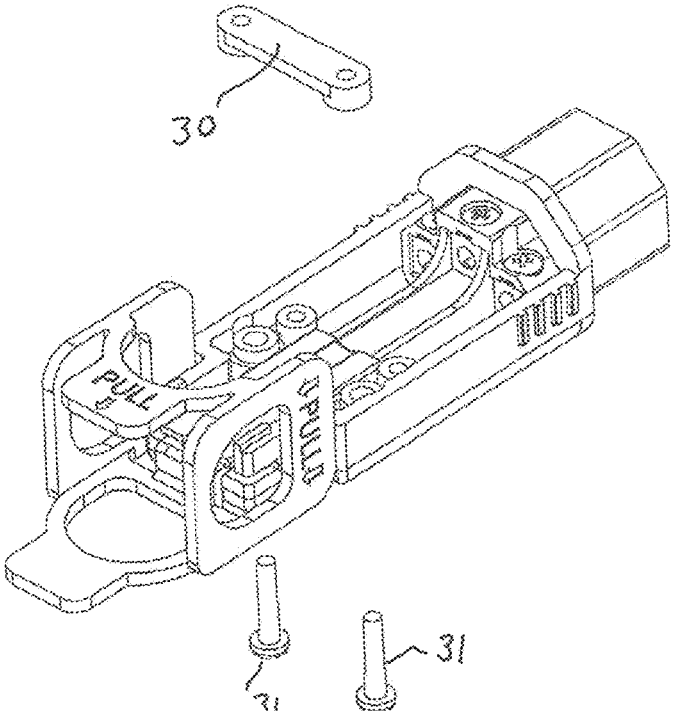

FIG. 4 shows removal of the screws 31 to effect release of the grip bar 30.

Figure 5:
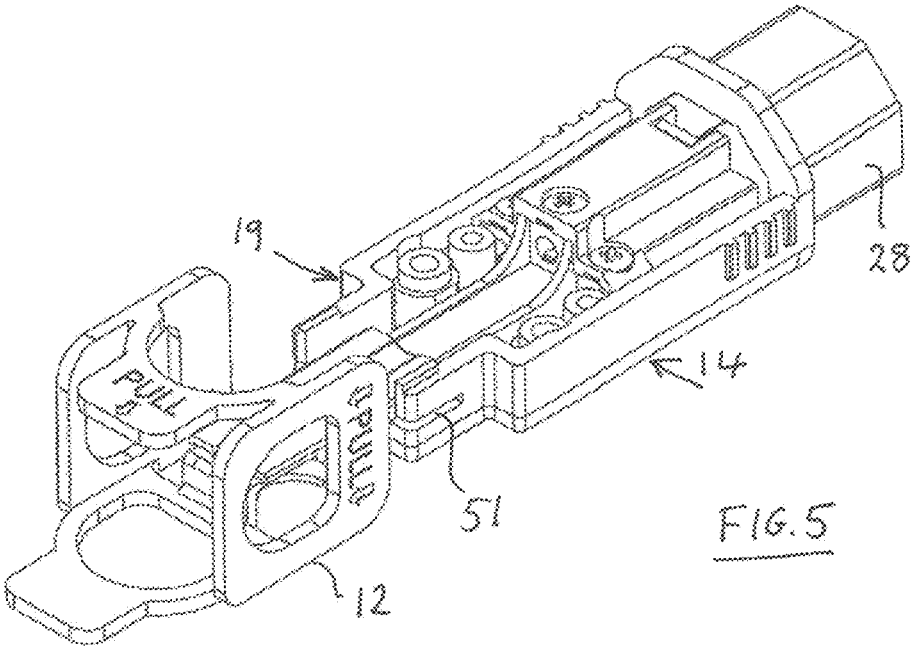

FIG. 5 shows removal of the main and secondary chassis by sliding them away from the end 19 of the housing base 14.

Figure 6:
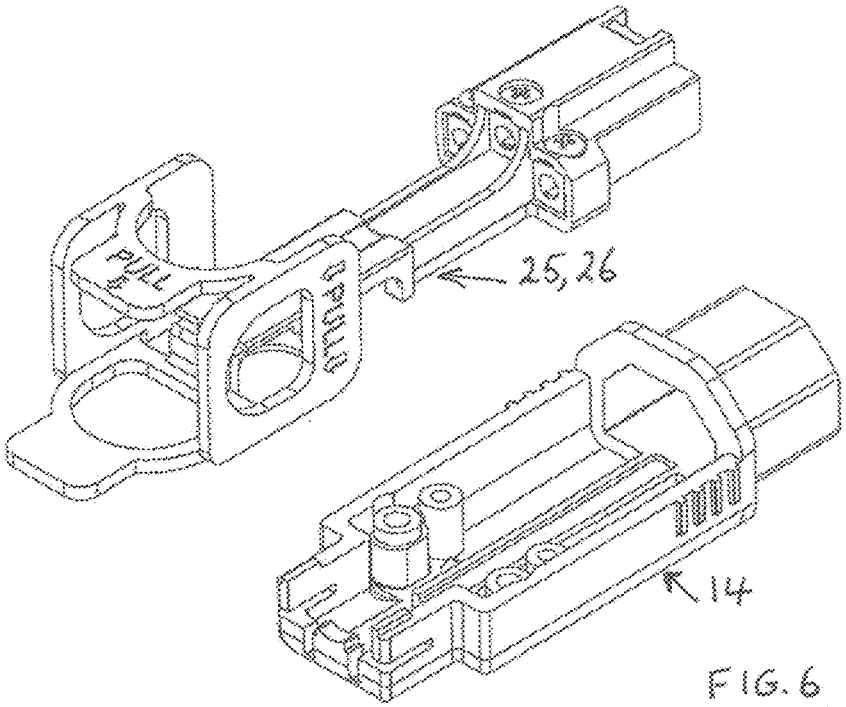

FIG. 6 shows the main and secondary chassis having been lifted out of the housing base.

Figure 7:
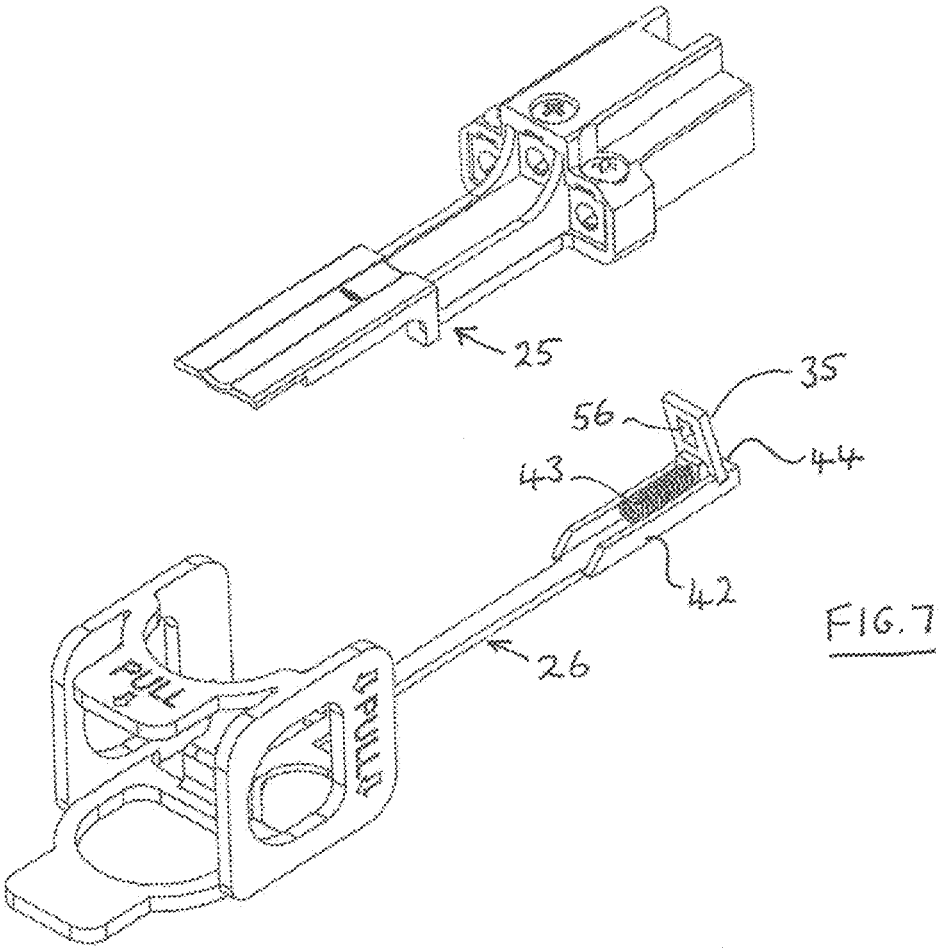

FIG. 7 shows the main and secondary chassis having been separated.

Figure 8:
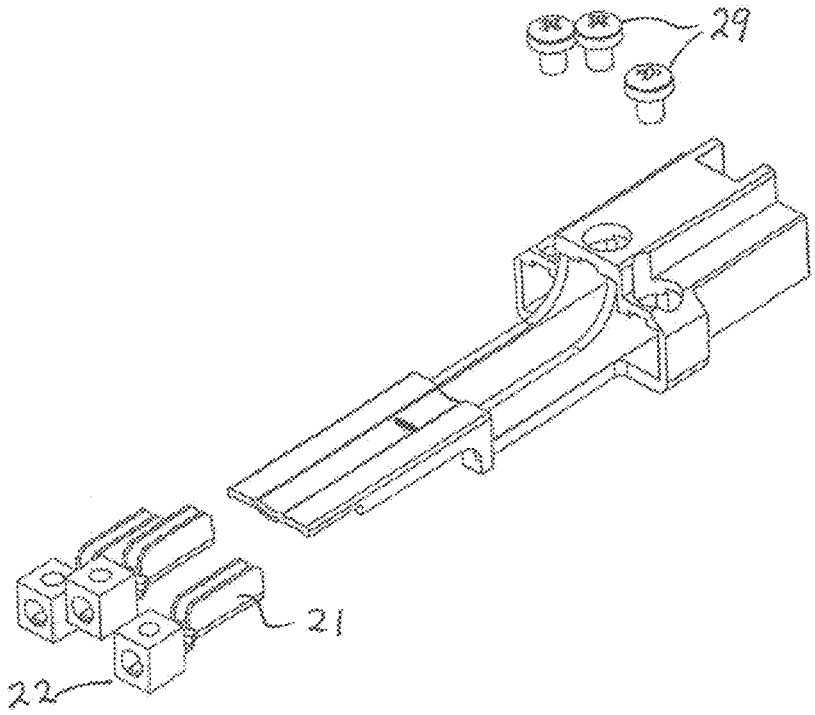

FIG. 8 shows removal of the terminal screws to allow the terminals to be slid out from the chassis.

Subsequently, for connecting the conductors of a cable, each conductor is inserted in a respective terminal and the screws 29 are then employed to serve the dual purpose of locating the terminal within the housing surround 28 and securing the conductors within the terminals. Subsequently the components of the connector are re-assembled in a sequence reversed to that shown in the FIGS. 3 to 8, with the cable having been arranged to pass centrally through the handle 12 and to be secured in position by means of the grip bar 30.

In a second embodiment of the present invention a connector 60 is constructed substantially as described in respect of the first embodiment but the handle 61 is of a different design. The handle 61 comprises only one pair of apertures 62 which may be employed as finger grip positions in contrast to the four finger grip positions of the handle of the first embodiment. Additionally the handle is devoid of the end tabs 55 of the aforedescribed handle 12 and in consequence the connector is of a shorter overall length. Also the grooves 51 are replaced by ribs 63 that locate with grooves in the handle.

Figure 9:
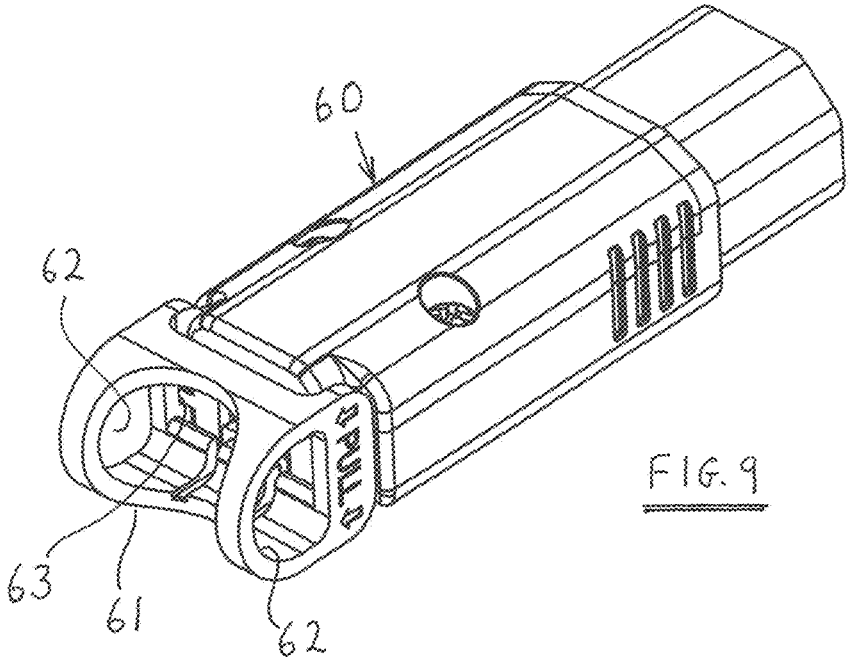
FIG. 9 is a perspective view of a connector in accordance with a second embodiment of the present invention.
Figure 10:
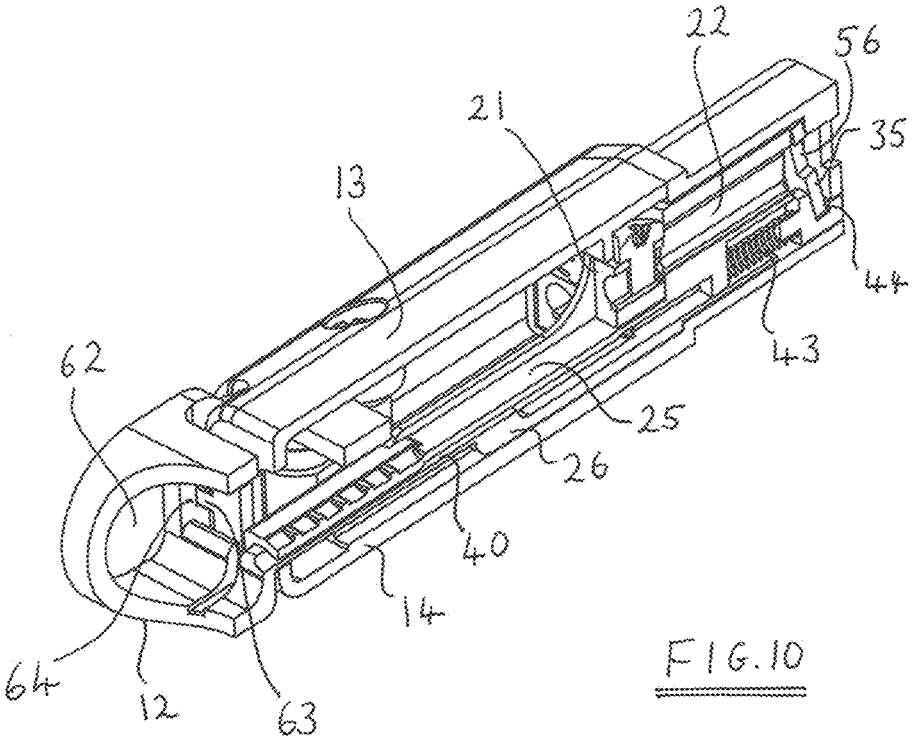
FIGS. 10 and 11 are part cut-away views of the connector of FIG. 9 when respectively in a locked and an unlocked position.
Figure 11:
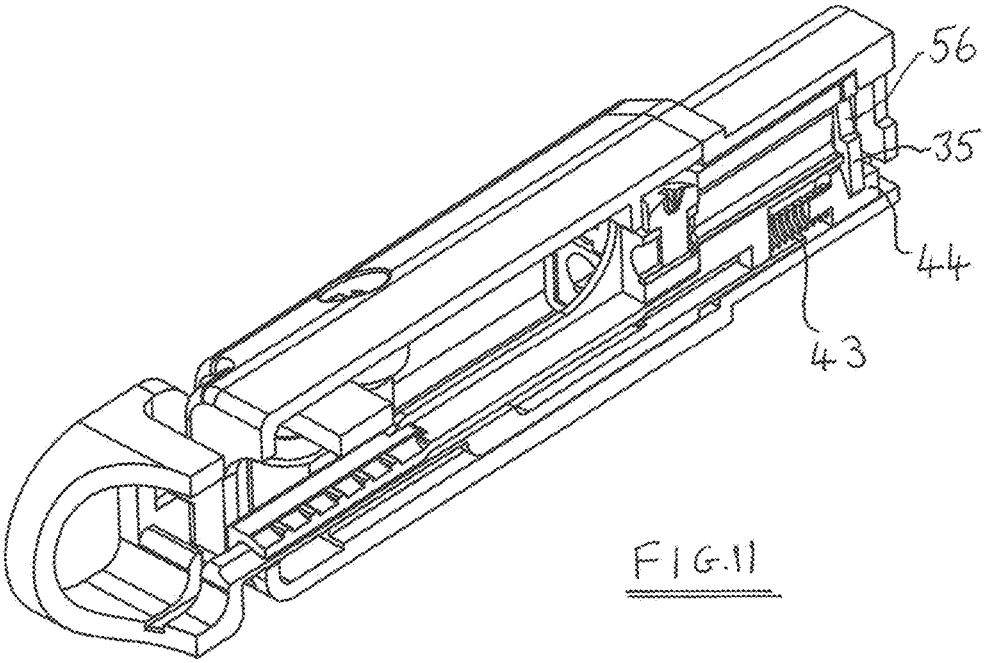

The connector of FIG. 9 is shown in perspective, in longitudinal cross-section in FIGS. 10 and 11 to reveal the internal construction which corresponds with that of the first embodiment.

In FIG. 10 the connector is in a locked orientation whereby the spring 43 urges the locking plate 35 to reside in a tilted position. In that tilted position the aperture 56 is able to engage with and lock an appropriately sized pin of a complimentary component to which the connector is connected.

In the event of the handle being pulled away from the body 10, as shown in FIG. 11, the spring 43 is compressed as the end face abutment 44 of the secondary chassis 26 moves the locking plate to a vertical position at which the aperture 56 presents an enlarged opening to allow disengagement of the connector from a pin.

From the foregoing it will be understood that the present invention provides a connector of a type which is both lockable and is particularly suitable for re-wiring.

The invention claimed is:

1. A re-wireable electrical connector having a terminal socket and comprising:

a locking mechanism to enable the pin of a complementary conductor to be retained in the terminal socket and released therefrom, a housing top and a housing base securable together to house a primary chassis member in a sandwich arrangement in which the primary chassis member is secured in position between the housing top and the housing base, wherein said primary chassis member is removable from the housing top and the housing base and comprises at least one terminal to which a cable conductor may be secured, said housing top and the housing base being separable for access to said at least one terminal, said at least one terminal being configured to be in electrically conductive contact with the terminal socket into which the pin of the complementary conductor may be inserted, and said locking mechanism comprising a release mechanism which comprises a secondary chassis member that is slidable relative to the housing top and the housing base in a direction which is towards and away from the terminal socket and which is perpendicular to the direction in which the housing top and the housing base are separable for access to said at least one terminal of said primary chassis member, said direction being parallel with the length direction of the electrical connector, wherein the primary chassis member comprises a support surface for a cable, said support surface facing one of the housing top and the housing base, and wherein said secondary chassis member is positioned between the primary chassis member and the other of said housing top and the housing base.

2. The electrical connector according to claim 1, wherein the primary chassis member supports a plurality of terminals.

3. The electrical connector according to claim 1, wherein the primary chassis member is secured in position in an assembled connector by inter-engaging with a formation which is part of the housing base or the housing top.

4. The electrical connector according to claim 1, wherein the primary chassis member is secured in position in an assembled connector by screws.

5. The electrical connector according to claim 1, wherein the primary chassis member is held in position by means provided for securing together the housing top and the housing base.

6. The electrical connector according to claim 1, wherein the release mechanism comprises a handle formation which is slidably supported relative to the housing top and the housing base.

7. The electrical connector according to claim 6, wherein the handle formation is secured to or integral with a secondary chassis member that is slidable relative to the housing top and the housing base.

8. The electrical connector according to claim 7, wherein the locking mechanism comprises a tiltable locking blade and the secondary chassis member comprises a control arm which extends from the handle formation towards the locking blade.

9. The electrical connector according to claim 7, wherein the primary chassis member comprises a support surface for a cable, said support surface facing one of the housing top and the housing base, and wherein said secondary chassis member is positioned between the primary chassis member and the other of said housing top and the housing base.

10. The electrical connector according to claim 6, wherein the handle formation and at least one of the housing top and the housing base comprise inter-engaging formation whereby the handle formation is guided for sliding movement in a direction parallel with the length direction of the electrical connector.

11. The electrical connector according to claim 6, wherein the housing top and the housing base define a recess in which part of the handle formation resides.

12. The electrical connector according to claim 6, wherein as considered in a plane perpendicular to the length of the connector the handle formation has a cross-sectional shape no larger than that of the assembled housing top and the housing base.

13. The electrical connector according to claim 6, wherein said at least one terminal is located between the terminal socket and the handle.

14. An electrical connector according to claim 1, wherein the locking mechanism comprises a release mechanism operable by a handle formation which is slidably supported relative to the housing top and the housing base and which is secured to or integral with the secondary chassis member.

15. A re-wireable electrical connector having a terminal socket and comprising:

a locking mechanism to enable the pin of a complementary conductor to be retained in the terminal socket and released therefrom, a housing top and a housing base securable together to house a primary chassis member in a sandwich arrangement in which the primary chassis member is secured in position between the housing top and the housing base, wherein said primary chassis member is removable from the housing top and the housing base and comprises at least one terminal to which a cable conductor may be secured, said housing top and the housing base being separable for access to said at least one terminal, said at least one terminal being configured to be in electrically conductive contact with the terminal socket into which the pin of a complementary conductor may be inserted, and said locking mechanism comprising a release mechanism which comprises a secondary chassis member that is slidable relative to the housing top and the housing base in a direction which is towards and away from the terminal socket and which is perpendicular to the direction in which the housing top and the housing base are separable for access to said at least one terminal of said primary chassis member, wherein the release mechanism comprises a handle formation which is slidably supported relative to the housing top and the housing base, wherein said at least one terminal is located between the terminal socket and the handle formation, wherein the primary chassis member comprises a support surface for a cable, said support surface facing one of the housing top and the housing base, and wherein said secondary chassis member is positioned between the primary chassis member and the other of said housing top and the housing base.

* * * * *